United States Patent [19]

Stull

[11] 4,281,778

[45] Aug. 4, 1981

[54] LOCKING CLOSURE CAP

[76] Inventor: Morton Stull, Split Rock Rd., Boonton Township, Morris County, N.J. 07005

[21] Appl. No.: 113,433

[22] Filed: Jan. 18, 1980

[51] Int. Cl.[3] ..... B65D 25/42; B65D 55/02

[52] U.S. Cl. ..... 222/153; 222/543; 222/546; 215/214; 215/330

[58] Field of Search ..... 222/153, 543, 546; 215/330, 214, 216

[56] References Cited

U.S. PATENT DOCUMENTS

| | | | |
|---|---|---|---|
| 3,240,405 | 3/1966 | Abbott | 222/546 X |
| 3,826,394 | 7/1974 | Stull | 222/546 X |
| 4,127,221 | 11/1978 | Vere | 222/543 X |

FOREIGN PATENT DOCUMENTS

| | | | |
|---|---|---|---|
| 480990 | 12/1969 | Switzerland | 222/546 |

*Primary Examiner*—Robert J. Spar
*Assistant Examiner*—Frederick R. Handren
*Attorney, Agent, or Firm*—H. Gibner Lehmann; K. Gibner Lehmann

[57] ABSTRACT

A closure cap construction for a dispensing container, the cap portion thereof being of the type intended to be held permanently captive on the container and having a dispensing orifice permitting selective discharge of the container contents. The cap portion comprises a body having an internal, double-helical screw thread adapted to engage a corresponding screw thread on the neck of the container. In addition, the body has an internal, downwardly facing shoulder from which there extends a series of molded, integral locking ratchet teeth. The upper ends of the teeth are joined to the shoulder so that the latter provides a stiffening effect which minimizes undesirable flexing or deformation of the teeth. The opposite or lower ends of the teeth are exposed and unconnected, and are intended to by-pass a series of cooperable locking ratchet teeth on the container neck. Also, the root diameters of both the internal thread and the cap locking teeth are substantially the same, which simplifies the molding of the cap. In addition, due to the fact that the ratchet teeth of the cap are disposed above the level of the internal cap threads, the locking teeth do not interfere with the threads as the latter are being "started"; this arrangement reduces the manufacturing cost in that it facilitates the use of high-speed, automatic capping equipment after the filling of the containers with the intended product.

18 Claims, 6 Drawing Figures

Fig. 3
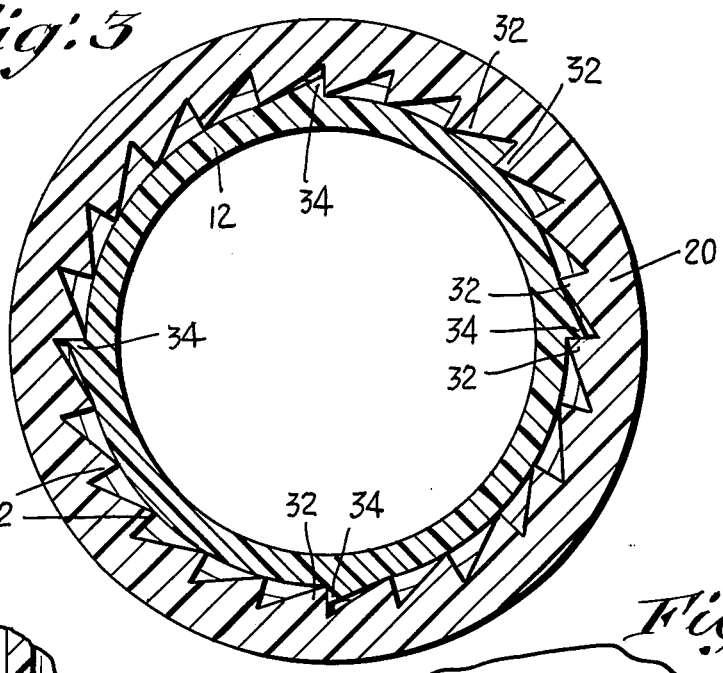
Fig. 6
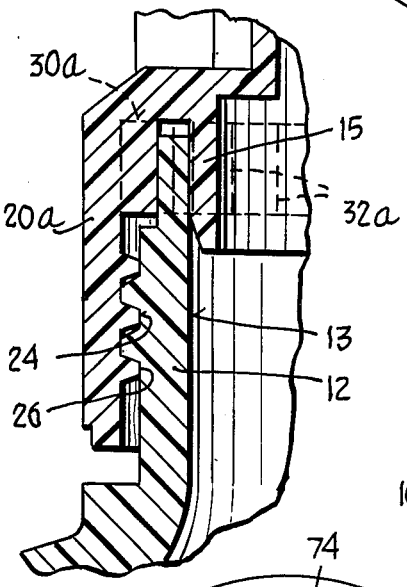
Fig. 4
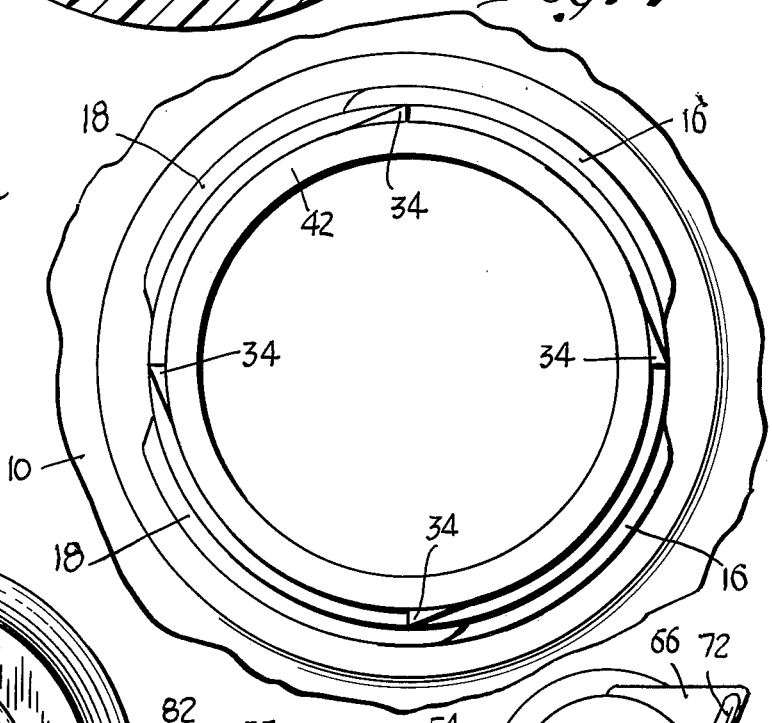
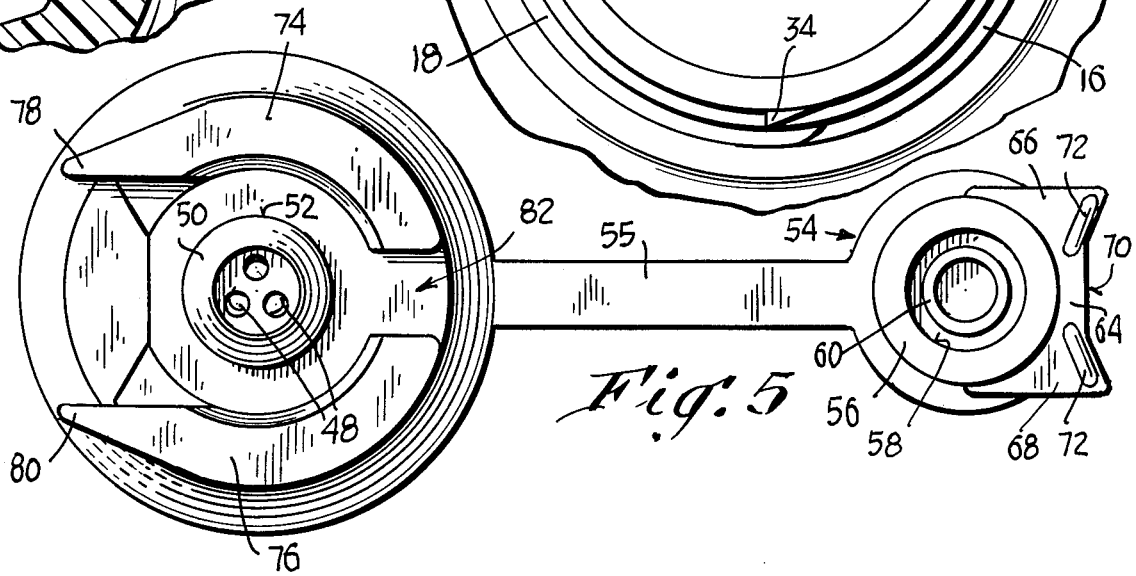
Fig. 5

LOCKING CLOSURE CAP

BACKGROUND

This invention relates generally to safety and child-proof closures adapted to be employed with containers for various types of fluids, including toxic and/or flammable liquids, and more particularly to locking cap constructions of the type intended to be held permanently captive on the dispensing container throughout substantially the entire life thereof.

In the past, a number of different safety screw cap constructions have been proposed and produced. Generally, where metal cans were employed as dispensing containers, the closure cap was constituted as a molded plastic part having an annular camming surface disposed adjacent to an annular retainer groove, such that the cap could be installed in the dispensing aperture of the container by merely forcing the camming surface thereof past the wall of the aperture. The aperture wall then became seated in the groove, completing the assembly. The fit between the cap and the walls of the dispensing aperture of the container was snug, whereby the cap was permanently retained by a sealing engagement that was effected, to minimize the possibility of leakage occurring.

With the advent of newer packaging concepts, there has been a shift away from the use of metal containers, and toward the use of the less costly, formed plastic types. This has created the need for different approaches, in order to accommodate the use of known locking closure caps as employed on plastic bottles or containers of existing designs or shapes. Generally, such plastic containers had neck portions of reduced diameter, externally threaded, with a standard thread of the type that is commonly known as "modified buttress", this being characteristic of the majority of plastic and glass containers in use today.

Generally, closure caps of the above type incorporated a closure plug or cover that was connected by means of a flexible hinge to the cap body, and that could be snapped into place on the body in a position to seal off one or more of the dispensing openings. The body was assembled to the dispensing container at the factory, in a manner that was intended to permanently hold it captive against either inadvertent displacement, or against intentional removal by the consumer, and particularly small children. Inadvertent removal of the cap body from the container was considered a hazard, since not only did there exist the possibility that the contents of the original container might be spilled or swallowed, but also such removal would tempt the adult consumer to re-fill the container with other substances which could be of a damaging or corrosive nature. Re-use of the container, as by re-filling, was thus considered to constitute a distinct danger, and accordingly, various attempts were made by manufacturers to discourage such activity.

Some prior cap constructions suffered from poor retention on the container, or poor sealing characteristics, or both. These devices therefore were unsatisfactory to the consumer from the standpoint of safety, particularly where either poisonous fluids were involved, or flammable liquids, such as charcoal lighter fluids and the like.

Cooperable interference lugs on the individual pieces of a two-part closure cap for a container have already been employed with moderate success, for holding captive one part of the cap and preventing its inadvertent removal. The problems with most all prior constructions, however, was that such lugs were difficult to incorporate into the molds for the various parts. The nature of the lugs, as well as the dimensions thereof, had to be such that they could readily by-pass one another and yet provide a positive retention against unscrewing and inadvertent removal. Sometimes the lugs interfered with the assembly of the closure cap, this often occurring where automatic screw capping equipment was being employed. When this occurred, either the equipment jammed, or the plastic parts were permanently damaged or otherwise deformed. In some instances, the nature of the lugs was such that a positive retention was not realized, and the safety closure function of the cap was thereby lost.

In prior constructions involving molded plastic containers, several attempts have been made in order to provide a seal between a molded closure cap and the outer surface of the small-diameter neck of the container. Due to the fact that in almost all cases there exists a parting line where two casing (container) halves meet, problems with obtaining an adequate seal have arisen, stemming from the discontinuity of the halves at this parting line. Accordingly, in almost all constructions involving sealing against the outer surface of the neck, leakage resulted. Such leakage was considered unacceptable in most cases, due to the potential hazards where toxic and/or flammable liquids were being packaged.

SUMMARY

The above disadvantages and drawbacks of prior closure cap constructions are obviated by the present invention, which has for an object the provision of a novel and improved closure construction which is especially simple, reliable in operation, and which can be fabricated at minimal overall expense.

A related object of the invention is the provision of a closure as above characterized, wherein the parts can be economically molded in plastic, in simple mold cavities.

Still another object of the invention is to provide an improved closure which in accordance with the foregoing can be readily assembled to a dispensing container with a minimum of time, and employing high production techniques such as the use of automatic capping equipment.

A still further object of the invention is the provision of a closure construction wherein only minor modification of the existing container neck is required in order to accommodate the closure cap, such modification not materially affecting the overall dimensions of the neck, or of the adjacent areas of the container itself.

A feature of the invention is the provision of a closure construction wherein a cap body is adapted to be screwed directly onto a container neck and permanently retained thereon, and wherein the container neck is integral with the remainder of the container, whereby the neck cannot separate, and such that leakage from the neck area is completely eliminated.

Yet another object of the invention is the provision of a closure cap as above characterized, which further incorporates reliable child-resistant safety features to prevent inadvertent removal of the cover by small children, thereby minimizing the likelihood of spillage or swallowing of the contents, etc.

A related object is the provision of a locking cap construction as above, wherein the surfaces of engagement between the container and the cap are disposed at location which are virtually completely free of mold parting lines, thus providing an improved seal over that obtainable in many prior closure constructions involving seal surfaces lying along or adjacent to the locations of the parting lines.

The above objects are accomplished by the provision of a closure cap construction for a dispensing container, the cap being of the type intended to remain captive on the container at all times, and having a dispensing orifice which can be selectively closed off, to thereby control the discharge of the container contents. The construction is in the form of a screw cap having a body with an internal, double-helical screw thread for engagement with a corresponding screw thread on the neck of the container. A series of molded, integral locking ratchet teeth is provided on the inner surface of the body, with the upper ends of the teeth being joined to an annular, downwardly facing shoulder. The shoulder provides stiffening for the teeth, and minimizes the tendency for the same to become deformed or distorted, particularly during the assembly of the cap to the container. The lower ends of the teeth are exposed, and engage cooperable ratchet teeth on the container neck, such engagement preventing removal of the cap, once it has been screwed into place. Due to the fact that the cap teeth are above the location of the internal cap threads, no interference with the threads is encountered, this being particularly important where automatic capping equipment is employed. The cap also includes an annular seal, which engages a cooperable seal surface on the neck of the container, at a location on the lip of the neck or on the inner surface thereof, such location being substantially completely free of any discontinuities of the type resulting from joining of molded parts, etc. As a result, a positive seal is achieved. This is considered to be very important from the standpoint of safety, since often such containers are used with toxic and/or flammable fluids. In the event that the seal between the closure cap and container neck were deficient, leakage could result. Such leakage could present a threat to small children, from the standpoint of either accidental poisoning or inadvertent fire.

Other features and advantages will hereinafter appear.

In the accompanying drawings, illustrating several embodiments of the invention:

FIG. 3 is a section taken on the line 3—3 of FIG. 1.

FIG. 4 is a fragmentary top plan view of the container of FIG. 2.

FIG. 5 is a top plan view of the screw cap of FIG. 1, shown with its cover removed, but held captive thereon by a hinge web structure.

FIG. 6 is a fragmentary section of a modified locking enclosure, constituting another embodiment of the invention.

Figure 1:
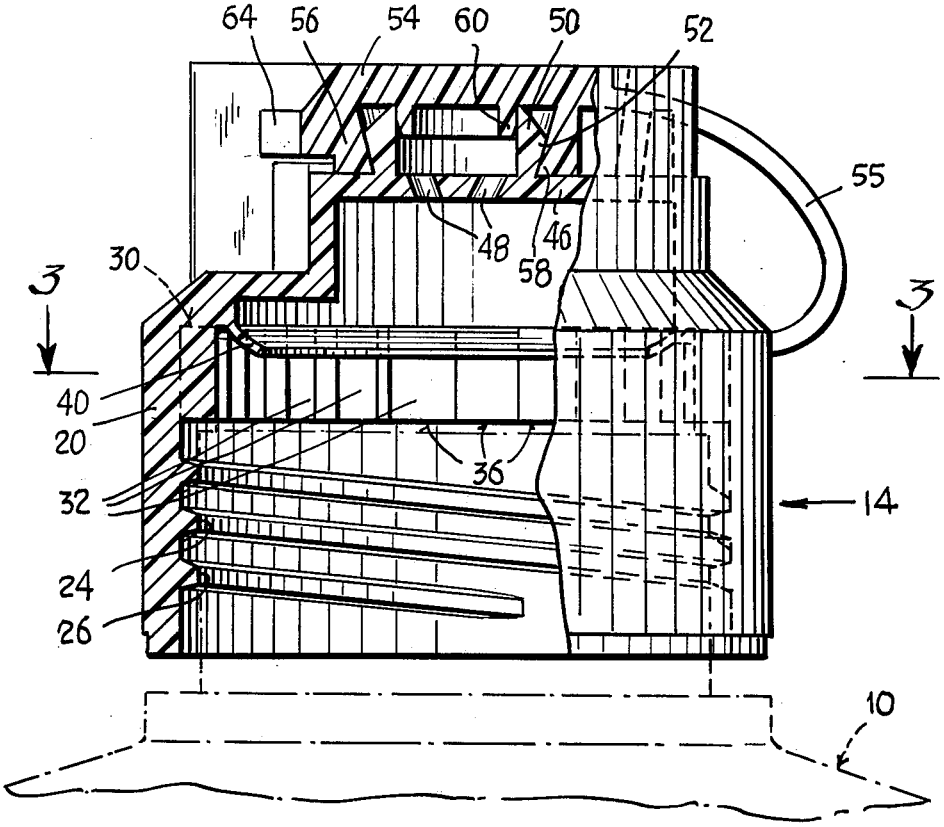
FIG. 1 is a view, partly in elevation and partly in vertical section, of a dispensing container incorporating the improved locking enclosure construction of the present invention.

Referring first to FIG. 1, there is illustrated a dispensing container generally designated by the numeral 10, preferably in the form of a molded plastic bottle, the container having a threaded neck portion 12 and carrying a molded plastic closure cap construction 14. The neck portion 12 has a double-lead helical screw thread, one of the threads being designated 16, and the other being labeled 18, which are adapted to be engaged by cooperable double-lead internal screw threads 24, 26 on the inner surface of the cap body 20.

In accordance with the present invention there is provided a novel and improved positive, leak-resistant locking arrangement for holding the cap construction 14 permanently captive on the container 10, while at the same time not interfering with the assembly of the two parts at the manufacturing facility where the container is filled with the product that is intended to be dispensed.

Figure 2:
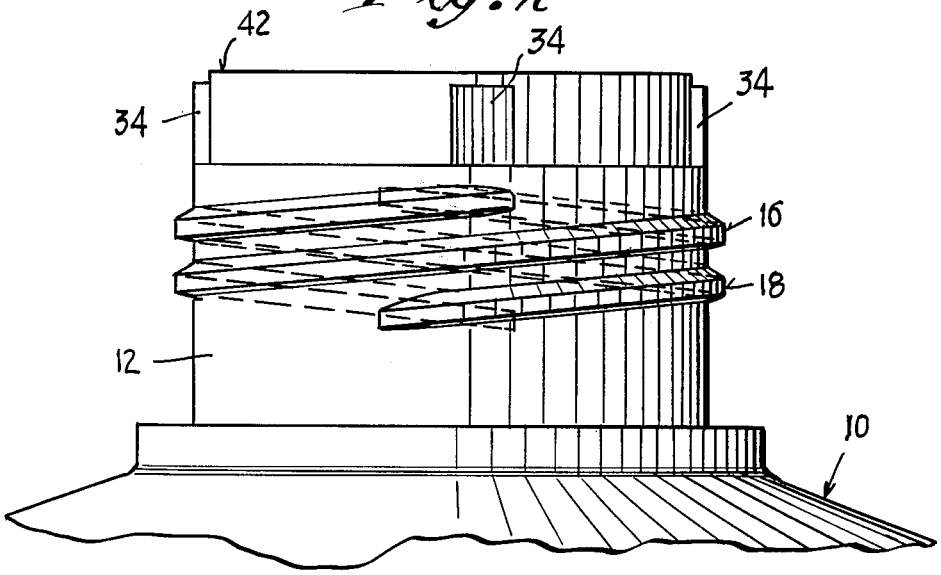
FIG. 2 is a side elevation of the container per se, particularly showing the threaded neck portion thereof.

Referring again to FIG. 1, there is disposed on the underside of the cap body 20, an internal, downwardly facing shoulder 30 from which there depends a series 32 of circularly-disposed ratchet teeth which are adapted to be engaged by cooperable, outwardly-facing locking ratchet teeth 34 shown in FIGS. 2 and 4, molded integral with the container neck 12, as the cap body 20 is screwed in place. As shown, the teeth 32 are preferably integral with the shoulder 30, the upper ends of the said teeth 32 being molded in such a way as to be a part of the shoulder. With such an arrangement, the shoulder 30 provides a desirable stiffening action to the teeth, such that excessive flexing or possible deformation of the same is minimized. In addition, the lower ends 36 of the teeth 32 are exposed and unconnected, such that minimal interference is encountered with the teeth 34 on the container neck 12 as the cap body 20 is being installed.

The exact number of ratchet teeth 32 that is employed is not critical. It has been found, however, that a series of close-spaced teeth 32 will provide satisfactory locking characteristics, even when used with a bottle neck 12 having considerably fewer teeth. In the illustrated embodiment, the center-to-center spacing between the teeth 32 is roughly the same as the overall circumferential dimension of one tooth, from its leading edge to its trailing edge, this arrangement having been found to provide satisfactory locking retention. Also, as can be seen in FIG. 1, the root diameter of the row of teeth 32 is substantially the same as the root diameter of the internal threads 24, 26 of the cap body, this arrangement simplifying the molding of the cap.

Referring again to FIG. 2, in the illustrated embodiment, the neck 12 is provided with two pairs of teeth 34, each tooth being spaced circumferentially by 90° from the adjacent tooth. This arrangement should not be considered limiting, but instead serves as an example as to the particular configuration which has been found to provide satisfactory results from the standpoint of positive retention, without giving rise to problems of extensive drag or interference with the cooperable teeth of the cap 14 as the latter is being assembled to the container.

Disposed on the inner surface of the cap body, adjacent to and integral with the shoulder 30, is a yieldable annular seal in the form of a deformable sealing skirt 40 which is preferably of thin cross-section, having a substantially conical configuration. The skirt 40 extends downward from and is connected directly to the shoulder 30, and is adapted to sealingly engage the lip 42 of the container neck portion 12. As this occurs, the skirt flattens slightly so as to press against the lip. Such a construction helps eliminate any leakage which would otherwise occur, past the cap and neck threads.

Referring again to FIGS. 1 and 5, the body 20 has an integral raised, apertured top wall or plateau portion 46 with one or more discharge or dispensing orifices 48. The orifices can be either skewed with respect to the axis of the cap body 20 as shown, or alternately can be substantially parallel thereto. The illustrated configuration of the dispensing orifices 48 is intended to provide a dispersion characteristic to the stream of product emanating from the container 10, during use of the dispenser.

The plateau portion 46 has an upstanding skirt 50 with an annular sealing and retainer bead 52 having a relatively sharp edge. There is cooperable with the cap body 20 a cap cover 54 which is connected to the body 20 by means of a flexible web 55, and which is adapted to be installed on the body overlying the top wall 46 thereof and covering the dispensing orifices 48. The cover 54 includes a depending sealing skirt 56 having an internal annular bead or bead-like formation 58, which forms a primary seal with the upstanding skirt 50 when the cover is closed as in FIG. 1. It will be seen that as the cover is opened or closed, the beads 52 and 58 bypass one another. The sharp edge of the bead 52 bites into the wall of the skirt 56, in order to provide a good seal. The cover 54 further comprises a depending sealing plug 60 of annular configuration, this constituting an additional or secondary seal of the dispenser, which is desirable from the standpoint of minimizing leakage during both storage and shipping, and keeping the product from flowing into the area adjacent the beads 50 and 56.

Further in accordance with the present invention, the cap body 20 incorporates a safety feature which minimizes the possibility that the contents of the dispenser can be accidentally discharged and possibly spilled, or else swallowed by an infant or small child.

FIG. 5 is a top plan view of the cap construction 14 particularly showing the hinge connecting web 55 and cover 54. By virtue of the provision of the web 55, the cover 54 is held captive at all times, and there is thus eliminated the possibility that it might be inadvertently lost or misplaced during use of the dispenser. The cover is provided with a finger-engageable lifting tab 64 by which it can be removed, by prying off, to thereby expose the discharge orifices 48. The lifting tab 64 is shown as having two ears 66 and 68, defining an arc 70 therebetween which is adapted to accommodate the nail of the user when it is desired to lift the cover. Small pads or lands 72 are molded integral with the lifting tab so as to provide additional stiffness.

In providing the child-proof feature, there are disposed at the upper portion of the cap body two generally crescent-shaped raised barriers 74, 76 which extend on opposite sides of the cover 54 when the latter is assembled to the cap body, and which are either level with or raised a slight amount above the top surface of the cover. The barriers 74, 76 prevent a child from gripping the sides of the cover; also, the child cannot engage the opposite edges of the cover with his teeth, since the barriers block access to these areas. In addition, integral with the barriers 74, 76 are upstanding posts 78, 80 respectively which are intended to bar access to the lifting tab 64 of the cover. In particular, the posts 78, 80 will prevent a small child from prying the cover off by engaging the lifting tab 64 with his teeth, since all portions of the front edge and lifting tab 64 of the cover 54 lie completely within the confines of these posts. Accordingly, the above construction constitutes an important advantage from the safety standpoint, by reducing the possibility that the contents can be swallowed, or inadvertently spilled, possibly coming into contact with the child's eyes. This is especially important where caustic, corrosive, or poisonous substances are being dispensed, as can be readily appreciated.

As shown in FIG. 5, there exists a narrow passage 82 between the barriers 74 and 76, which provides clearance for the web 55 when the cover 54 is assembled to the cap body 20. Such a construction minimizes the possibility of the web 55 breaking at its junction with the cover 54, since this junction is well within the confines of the barriers 74, 76 when the cover is assembled to the cap body as in FIG. 1.

The above construction is seen to have the following advantages, resulting in low cost and trouble-free operation. Due to the fact that the neck portion 12 of the container is integral with the remainder thereof, and the cap body 20, once assembled at the factory, is permanently locked onto this neck portion, eliminating possible failure of the sealing and retention functions of the closure. Such an advantage is not enjoyed by some of the prior art devices, wherein a closure cap was carried on an intermediary member which in turn was snapped into or screwed onto the container or bottle which carried the product. In this connection, it is noted that virtually no unscrewing movement is possible following assembly of the cap onto the neck. Thus, once the cap is in place, with the sealing skirt 40 flattened against the lip 42, no leakage can occur past the area adjacent to and between the cap and neck threads.

With the present construction, the teeth 32 of the cap lie a substantial distance above the location of the cap threads 24, 26. The dimensions of the cap are such that the threads thereof begin to engage the neck threads 16, 18 well before the engagement of the teeth 32, 34 begins. As a result, such engagement cannot interfere with proper "starting" of the threads, this being particularly important where high-speed automatic capping equipment is being employed.

It is noted that the plastic material of which the cap and neck are constituted is sufficiently tough to prevent breaking of the teeth in the event that unscrewing of the cap is attempted, from the fully assembled position. The engagement of the sharp (radial) faces of the cap and neck teeth which prevents such unscrewing is particularly shown in FIG. 3, this arrangement having been found to be a highly satisfactory deterrent against unauthorized or accidental dislodgment of the cap from the container.

Due to the fact that the seal occurs at the lip 42 of the container, a more effective seal is made possible since this lip is normally free of the type of mold parting lines which are inherent in molded plastic bottles. Such parting lines are particularly prominent at diametrically opposite points along the outer surface of the neck portion 12. In prior constructions which incorporated seals involving the outer surface, the discontinuity caused by the parting line, no matter how small, resulted in poor seals, giving rise to undesirable leakage and its attendant hazards.

Where the container is constituted of molded plastic, the threads which are incorporated in the neck portion can be molded integral therewith, the same being true of the ratchet teeth 34. Such integral molding of the threads and teeth can result in a substantial cost saving, especially where large numbers of dispensers are to be mass produced.

Due to the fact that the cap body is capable of being molded of plastic as a single integral piece, there results a reduced manufacturing cost of the dispenser, while at the same time there is provided a product which is both rugged and reliable over its useful life, and economical to the point where it can be merely discarded at such time as the contents of the dispenser are depleted.

The locking arrangement of the cap body on the container neck, together with the child-resistant safety closure features outlined above, provide a dispenser which is especially safe, even when corrosive or poisonous substances are being dispensed, all with minimal expense, and without sacrificing ease of operation for the knowledgeable consumer. Moreover, because the cap is permanently retained on the container, the consumer is discouraged in his attempts to re-fill the same with other types of liquids, this feature of permanent cap retention thus constituting an important advantage from the safety standpoint. In certain other prior constructions where there did exist the capability of re-filling the container, problems arose where certain solvent-type solutions were used, some of these being capable of attacking and/or dissolving the plastic of which the container and closure were constituted. In the present construction, this hazard involving refill is virtually completely eliminated, since the orifices 48 are so small that they would not enable the container to be re-used unless special tiny fill-tubes of some type were employed. This possibility is considered to be extremely remote.

Another embodiment of the invention is illustrated in FIG. 6, showing a fragmentary section of a container neck portion 12 having multiple ratchet teeth identical to those shown in FIG. 2, and a modified cap construction comprising a body 20*a* having internal teeth 32*a* which are intended to lock with the neck teeth as in the previous embodiment. By the pesent invention, the underside of the cap body 20*a* has a downwardly facing shoulder 30*a* from which the teeth 32*a* extend, and a hollow, depending sealing plug 15 of generally annular configuration, adapted to sealingly engage the inner wall surface 13 of the neck 12 when the cap is installed on the container. This form of seal has been found to be equally as effective as that involving the deformable skirt 40 shown in FIG. 1. The effectiveness of this seal results from the fact that during the molding of the container 10, the inner cylindrical surface 13 is formed by a cylindrical mold part which is free of surface discontinuities of the type which would give rise to parting lines, etc. Accordingly, this surface is smooth along its entire circumference, such that a snug fit with the plug 15 can be realized. In other respects, the operation of the embodiment of FIG. 6 is substantially the same as that of the first embodiment, and accordingly, further details are not repeated here.

The devices as illustrated and described above are thus seen to represent distinct advances and improvements in the technology of locking-type safety closures.

Variations and modifications are possible without departing from the spirit of the invention.

What is claimed is:

1. A closure cap construction for a dispensing container, said construction being of the type adapted to be held permanently captive on the container and having a closeable dispensing orifice for enabling discharge of liquid from the container when desired, comprising in combination:

(a) a molded, resilient plastic, locking-type screw cap having a cap body provided with an internal, downwardly facing shoulder, and having an annular sidewall provided with an internal screw thread disposed below said shoulder for engagement with corresponding screw threads on the neck of the container, (b) said cap body further having a top wall spaced above the level of said shoulder and containing an aperture, said aperture constituting the dispensing orifice of the said construction, (c) said cap body being provided with a set of multiple internal, circularly disposed ratchet teeth disposed below said shoulder and above said internal thread, said ratchet teeth being joined to said annular sidewall and extending radially inward therefrom for engagement with cooperable outwardly facing ratchet teeth on said container neck, so as to positively prevent unscrewing movement of the cap body with respect to the container, (d) the upper ends of said ratchet teeth of the cap body being joined to said internal shoulder and being integral therewith, said shoulder thereby effecting a stiffening of said teeth and minimizing the tendency for excessive deformation thereof, (e) the lower ends of said teeth being exposed and unconnected, to enable them to readily engage the container neck teeth as the cap construction is screwed onto the neck, (f) said cap body further including a yieldable annular seal disposed radially inward of the set of ratchet teeth, (g) the root diameter of the set of ratchet teeth being substantially the same as the root diameter of the internal thread of the cap body.

2. The invention as defined in claim 1, wherein:

(a) said annular seal comprises a thin, yieldable skirt joined to said shoulder, (b) said skirt being adapted for engagement with the lip of the container, so as to constitute a leak-resistant seal therewith.

3. The invention as defined in claim 2, wherein:

(a) said skirt has a generally conical cross sectional configuration.

4. The invention as defined in claim 2, wherein:

(a) the skirt is deformed by flattening as the closure cap construction is tightened onto the container.

5. The invention as defined in claim 1, wherein:

(a) said cap body has a cover adapted for installation on said body, adjacent the top wall thereof, and (b) cooperable means on said cap body and cover for releasably retaining the latter in a position overlying the dispensing orifice whereby the latter is sealed against leakage.

6. The invention as defined in claim 5, wherein:

(a) said cap body has an upstanding skirt surrounding the discharge orifice, (b) said cooperable retainer means comprising an annular bead on the upstanding skirt, (c) said cover having a depending skirt and an annular bead thereon, (d) said beads being adapted to by-pass one another during installation and removal of the cover from the cap body.

7. The invention as defined in claim 6, wherein:

(a) the annular bead on the upstanding skirt has a sharp edge which bites into the depending skirt of the cover, and effects a seal therewith.

8. The invention as defined in claim 1, wherein:

(a) said cap body has an upstanding skirt surrounding the discharge orifice, (b) a cover adapted for installation on said body, (c) said cover having a depending sealing plug receivable in the upstanding skirt of the cap body, and forming a leak-resistant seal with wall portions thereof.

9. The invention as defined in claim 1, and further including:

(a) a cover adapted for installation on said cap body, (b) a hinge web connecting said cap body and cover for holding the latter captive on the body at all times.

10. The invention as defined in claim 1, and further including:

(a) a cover adapted for installation on said cap body, and (b) a finger engageable lifting tab on the cover, to facilitate prying the same off the cap body.

11. The invention as defined in claim 10, and further including:

(a) a pair of barriers disposed at the top of the cap body, (b) said barriers defining a central recess into which the cover can fit, so as to bar access to the cover by unauthorized personnel.

12. The invention as defined in claim 11, and further including:

(a) a hinge web connecting the cover to the cap body, (b) each of said barriers being substantially crescent shaped, (c) adjacent portions of the barriers being spaced apart a distance sufficient to provide clearance for the web when the cover is installed on the body, and constituting a guard to minimize the likelihood of breakage of the web at the area where it joins the cover.

13. The invention as defined in claim 11, and further including:

(a) a pair of upstanding posts integral with the barriers respectively, (b) said upstanding posts barring access to the lifting tab and preventing direct engagement thereof by the teeth of a small child.

14. The invention as defined in claim 1, and further including:

(a) a container having an externally threaded neck, (b) said neck comprising a pair of ratchet teeth disposed adjacent to the lip of the neck, (c) the teeth of said pair being spaced apart by substantially 180° from one another.

15. The invention as defined in claim 1, wherein:

(a) the cap ratchet teeth are spaced circumferentially from one another by a distance substantially the same as the circumferential length of each tooth, from its leading edge to its trailing edge.

16. The invention as defined in claim 1, and further including:

(a) a container having an externally threaded neck, (b) said neck comprising two pairs of ratchet teeth disposed adjacent to the lip of the neck, (c) the teeth of said pairs being spaced apart by substantially 90° from one another.

17. The invention as defined in claim 1, wherein:

(a) said annular seal comprises a hollow, depending plug adapted to extend inside the neck of the container, and to sealingly engage the inner wall of the latter, (b) said hollow plug being joined directly to said shoulder.

18. The invention as defined in claim 1, wherein:

(a) the internal screw thread of the cap body has a double lead, (b) the annular seal of said cap body extending downward from and being connected directly to said shoulder, (c) said seal extending below the upper ends of the ratchet teeth in said set.

* * * * *